US012350724B2

(12) United States Patent
Benedetti et al.

(10) Patent No.: US 12,350,724 B2
(45) Date of Patent: Jul. 8, 2025

(54) METHOD AND PLANT FOR PRODUCING FLAT ROLLED PRODUCTS

(71) Applicant: Danieli & C. Officine Meccaniche S.P.A., Buttrio (IT)

(72) Inventors: Gianpietro Benedetti, Tricesimo (IT); Paolo Bobig, San Canzian d'Isonzo (IT); Matteo Remy Bulfone, Colloredo di Monte Albano (IT)

(73) Assignee: Danieli & C. Officine Meccaniche S.P.A., Buttrio (IT)

( * ) Notice: Subject to any disclaimer, the term of this patent is extended or adjusted under 35 U.S.C. 154(b) by 0 days.

(21) Appl. No.: 18/281,998

(22) PCT Filed: Mar. 14, 2022

(86) PCT No.: PCT/IT2022/050054

§ 371 (c)(1),
(2) Date: Sep. 14, 2023

(87) PCT Pub. No.: WO2022/195639

PCT Pub. Date: Sep. 22, 2022

(65) Prior Publication Data

US 2024/0157418 A1 May 16, 2024

(30) Foreign Application Priority Data

Mar. 17, 2021 (IT) ..... 102021000006407

(51) Int. Cl.

| | |
|---|---|
| ***B21B 1/46*** | (2006.01) |
| ***B22D 11/12*** | (2006.01) |
| ***B22D 11/14*** | (2006.01) |

(52) U.S. Cl.
CPC ..... *B21B 1/463* (2013.01); *B21B 1/466* (2013.01); *B22D 11/1206* (2013.01); *B22D 11/147* (2013.01); *B21B 2201/08* (2013.01)

(58) Field of Classification Search
CPC ..... B22D 11/1206; B22D 11/147; B21B 1/46; B21B 1/463; B21B 1/466
See application file for complete search history.

(56) References Cited

U.S. PATENT DOCUMENTS

| | | | |
|---|---|---|---|
| 5,115,547 | A | 5/1992 | Rohde |
| 5,305,515 | A | 4/1994 | Fastert et al. |
| 5,467,518 | A | 11/1995 | Mertens |
| 5,943,753 | A | 8/1999 | Buchsbaum et al. |

(Continued)

FOREIGN PATENT DOCUMENTS

| | | |
|---|---|---|
| DE | 19839370 | 3/2000 |
| DE | 102005011254 A1 | 9/2006 |

(Continued)

OTHER PUBLICATIONS

International Search Report and Written Opinion of PCT/IT2022/050054 dated Jun. 29, 2022, 13 pages.

*Primary Examiner* — Kevin E Yoon
(74) *Attorney, Agent, or Firm* — Rankin, Hill & Clark LLP

(57) ABSTRACT

The invention concerns a method and a plant for obtaining strips (S), wherein the plant has at least three casting lines (11, 12, 13) disposed in parallel, of which two are lateral (11, 13) and one is central (12), and at least two rolling lines (14, 15) aligned with two of said at least three lateral casting lines (11, 12 13).

8 Claims, 5 Drawing Sheets

(56) References Cited

U.S. PATENT DOCUMENTS

| | | | | |
|---|---|---|---|---|
| 6,332,255 | B1 | 12/2001 | Buchsbaum et al. | |
| 2005/0039320 | A1 | 2/2005 | Thomanek | |
| 2011/0272116 | A1* | 11/2011 | Benedetti | B21B 1/46 164/424 |
| 2012/0006502 | A1 | 1/2012 | Bausch et al. | |

FOREIGN PATENT DOCUMENTS

| | | | | |
|---|---|---|---|---|
| EP | 0908244 | A2 | 4/1999 | |
| EP | 2944386 | A1 * | 11/2015 | B21B 1/46 |
| WO | WO0012235 | A1 | 3/2000 | |
| WO | WO-2009065840 | A1 * | 5/2009 | B21B 1/463 |
| WO | WO2011080064 | A2 | 7/2011 | |
| WO | WO2015049663 | A1 | 4/2015 | |

* cited by examiner (STATE OF THE ART)

(STATE OF THE ART)

METHOD AND PLANT FOR PRODUCING FLAT ROLLED PRODUCTS

FIELD OF THE INVENTION

The present invention concerns a method for producing flat rolled products, such as strip, and the corresponding production plant. In particular, the invention concerns a method and a plant which allow to obtain finished products both in continuous mode, with casting directly connected with rolling, and in discontinuous mode, starting from products cast in steps prior to rolling.

BACKGROUND OF THE INVENTION

Rolling plants disposed in line with a continuous casting machine that produces thin slabs, the so-called "thin slab caster", are known.

These rolling plants generally comprise a single rolling train located downstream of a continuous casting machine. It is known that the maximum casting speed that can be reached by the casting machine is significantly lower than the rolling speed of the rolling train which, in order to operate at high productivity, must be fed without interruptions.

Therefore, to increase the productivity of the rolling line, two or even three casting machines are provided which work in parallel to feed a single rolling mill downstream.

Between the casting machine or machines and the single rolling line it is known to dispose a respective equalization, heating and/or maintenance furnace, for example of the tunnel type, which also acts as an accumulation buffer for the cast product when it is necessary to overcome an interruption in the rolling process due to accidents or roll changes, thus avoiding loss of material and energy and, above all, avoiding an interruption of the casting itself.

These plants can be designed for a substantially continuous or so-called "endless" rolling process, in which the cast product is rolled continuously from the rolling train which is aligned with the casting machine, or for discontinuous "coil-to-coil" rolling processes, if the length of the slab corresponds to the material to form a coil, or "semi-endless" rolling processes if this length corresponds to a multiple of the length necessary to form a coil.

Examples of plants having two continuous casting lines that serve a single rolling train are shown in the prior art documents U.S. Pat. Nos. 6,332,255, 5,943,753 and US 2005/0039320. In these solutions, the rolling train is aligned with the casting axis of one of the two casting machines which are followed by a respective tunnel furnace, as shown by way of example in FIG. 1, where two casting lines 111, 112 are shown followed by respective tunnel furnaces 122, 123 and by a rolling line 114 aligned with a first 111 of said casting lines 111, 112. Document U.S. Pat. No. 5,467,518 shows, on the other hand, a plant having two casting lines with respective tunnel furnaces and a centrally disposed regenerative furnace followed by a rolling train.

The prior art documents US 2012/0006502, U.S. Pat. Nos. 5,305,515, 5,115,547 and WO 00/12235 show examples of plants having three casting lines and in which the rolling train is aligned with the axis of the centrally disposed casting machine, as is obvious from FIG. 2 in which, as well as two first casting lines 111, 112, a third casting line 113 is installed, followed by a corresponding tunnel furnace 124 and in which the central casting line 112 is followed by a rolling line 114 fed in a combined manner by all three casting lines 111, 112, 113.

In the configurations described, the tunnel furnaces act not only as heating devices but also as devices for the feed/transport of the slabs, and comprise one or more fixed sections and at least one mobile section that can be moved transversely with respect to the casting axes, or can be moved in rotation with respect to a fixed section of the furnace, so that two mobile sections of adjacent furnaces can cooperate to define a transfer path along which the slabs are conveyed toward the rolling train.

These plants that provide several casting lines allow to increase the productivity of the rolling mill in the case of semi-endless or coil-to-coil rolling processes because the rolling train can be fed with the desired frequency, but they do not allow to pass to endless mode without incurring any decrease in plant productivity.

In fact, in such plants, if it is necessary to carry out an endless rolling process, the other casting machines must necessarily be stopped, or used only to produce slabs to be stored and used later.

Furthermore, in the event of prolonged interruptions of the rolling train due to maintenance, accidents or other occurrences, it is still necessary, sooner or later, to interrupt the casting processes because tunnel furnaces, although they also act as an accumulation buffer, still have a limited containing capacity.

There is therefore a need to perfect a method and a plant for producing flat rolled products which can overcome at least one of the disadvantages of the state of the art.

One purpose of the present invention is to perfect a highly flexible method for producing flat rolled products, which can operate in each of the endless, semi-endless and coil-to-coil modes, and which allows to pass quickly between one rolling mode and another, ensuring high plant productivity even in the event of interruption of the casting process or the rolling process.

Another purpose of the present invention is to provide a plant for producing flat rolled products having high productivity, comprised between about 3 million tons/year and about 8 million tons/year.

Another purpose of the present invention is to provide such a plant which allows to roll the cast products at the same time both in endless mode and also in semi-endless or coil-to-coil mode, guaranteeing at the same time a high plant productivity even in the case of stoppages of the casting or of the rolling train due to breakdowns or maintenance.

The Applicant has devised, tested and embodied the present invention to overcome the shortcomings of the state of the art and to obtain these and other purposes and advantages.

SUMMARY OF THE INVENTION

The present invention is set forth and characterized in the independent claims. The dependent claims describe other characteristics of the present invention or variants to the main inventive idea.

According to the present invention, there is provided a method for producing flat rolled products, to obtain strips in a plant having at least three casting lines disposed in parallel with each other and at least two rolling lines aligned with two of the casting lines, so that at least the two rolling lines are in direct engagement with respective casting lines in order to be able to operate selectively also in endless mode.

In a configuration with three casting lines, there are identified two lateral casting lines aligned with the at least two rolling lines, and one casting line disposed centrally with respect to the two lateral casting lines.

The method provides:

a casting step, in which at least two of the three casting lines simultaneously produce a respective continuously cast product, a first cutting step, performed downstream of the casting when one or more of the lines operate in semi-endless or coil-to-coil mode, in which the cast product is cut into slabs of suitable length by means of a first shear, a movement step, in which the slabs or the cast product coming from the at least two casting lines are moved downstream through and/or by means of a respective tunnel furnace, each provided with one or more respective fixed modules and at least one respective mobile module suitable to cooperate, in an alternate manner, when one or more of the casting lines operate in semi-endless or coil-to-coil mode, with at least another one of the mobile modules of an adjacent tunnel furnace in order to selectively define a transfer path along which the slabs can be conveyed in a desired manner into an adjacent tunnel furnace and then toward one or both of the rolling lines, depending on the specific needs of the process, and a second cutting step, performed downstream of the rolling when one or more of the casting lines operate in semi-endless or endless mode, in which the rolled strip is cut by means of a second shear once the desired length of the coil to be produced has been reached.

According to the invention, the at least one mobile module of the tunnel furnace disposed centrally cooperates in an alternate manner with at least one mobile module of the tunnel furnaces disposed laterally.

According to a first operating mode of the method, the casting step occurs simultaneously in the three casting lines. The slabs produced in the central casting line are conveyed inside the respective tunnel furnace, and then, alternately, toward the rolling lines which are located downstream of the lateral casting lines, which operate in semi-endless or coil-to-coil mode.

According to a second operating mode of the method, the casting step occurs simultaneously in the lateral casting lines, which are in direct engagement in endless mode with the respective rolling lines, while the central casting line is stopped.

In a third operating mode, the central tunnel furnace can, however, be used to heat previously produced and stored slabs.

According to a fourth and fifth operating mode of the method, the casting step occurs in endless mode in one of the two lateral casting lines which is in direct engagement with the respective rolling line, while the other lateral casting line and the central casting line feed the other rolling line in semi-endless or coil-to-coil mode.

According to a sixth and seventh operating mode of the method, if it is necessary to interrupt the casting in one of the lateral casting lines, the casting step occurs in the other lateral casting line, still in operation, in direct engagement in endless mode with the respective rolling line, while the slabs produced simultaneously in the central casting line are conveyed toward the rolling line located downstream of the lateral casting line not in operation, which operates in coil-to-coil mode.

According to an eighth and ninth operating mode of the method, if it is necessary to interrupt the casting of the central casting line and one of the rolling lines is stopped, the casting step occurs simultaneously in the other lateral casting lines and the slabs produced in the lateral casting line having the downstream rolling line stopped are conveyed toward the operating rolling line, which operates in semi-endless or coil-to-coil mode.

According to a tenth and eleventh operating mode of the method, if one of the rolling lines is stopped, the casting step can in any case occur simultaneously in all the casting lines and the slabs produced in the central casting line and in the lateral casting line with the downstream rolling line stopped are conveyed toward the operating rolling line, which operates in semi-endless or coil-to-coil mode.

The invention also provides that if the rolling step occurs in endless or semi-endless mode, the continuous strip is cut transversely with a second flying shear, disposed at the end of the rolling line and in front of the downcoilers, once the length that determines the desired weight of the coil to be produced has been reached.

It is therefore evident that the plant configuration provided allows for a high production flexibility in all three possible rolling modes, namely endless, semi-endless and coil-to-coil. Furthermore, if one of the lines works in endless mode, the plant still maintains a high productivity. Furthermore, this production method allows to produce a very wide range of products, without needing to reduce or interrupt overall production.

Some embodiments described here also concern a plant for producing flat rolled products, to obtain strips starting from a continuously cast product possibly divided into slabs. The plant comprises:

at least three casting lines, of which two lateral ones and at least one central one, disposed in parallel, at least three respective tunnel furnaces disposed downstream of the corresponding casting lines and comprising one or more respective fixed modules and at least one respective mobile module, which are configured to cooperate in an alternate manner with at least one other mobile module of an adjacent tunnel furnace in order to selectively define a transfer path for the slabs toward one or both tunnel furnaces associated with the adjacent casting lines, at least two rolling lines aligned with the two lateral casting lines and comprising respective roughing and finishing trains between which a corresponding temperature restore system is disposed, at least one respective first pendular shear disposed between the casting line and the tunnel furnace, configured to allow the plant to operate in semi-endless or coil-to-coil mode, and at least one respective second flying shear disposed at the end of the rolling line and configured to allow the plant to operate in endless or semi-endless mode.

Advantageously, a common workshop can be provided between the at least two rolling lines for the turning, and therefore the restoration, of the worn rolling rolls.

BRIEF DESCRIPTION OF THE DRAWINGS

These and other aspects, characteristics and advantages of the present invention will become apparent from the following description of some embodiments, given as a non-restrictive example with reference to the attached drawings wherein.

Figure 2:
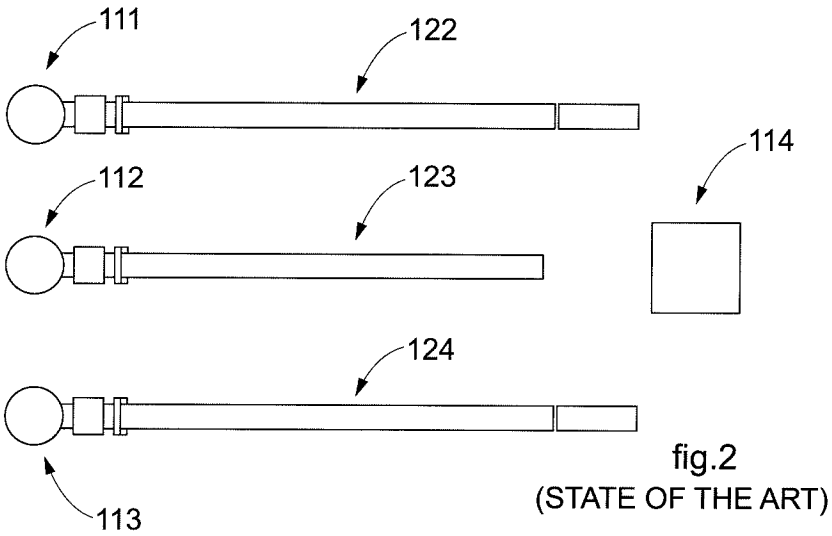
FIGS. 1-2 show two different layouts of a rolling plant according to the state of the art.
Figure 1:
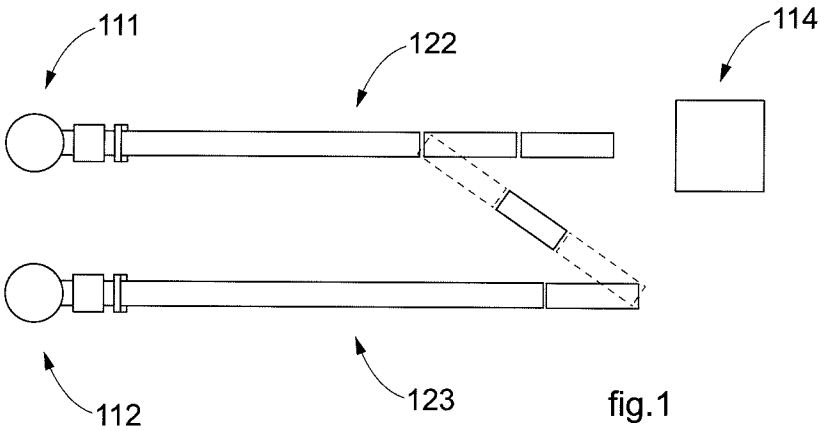

To facilitate comprehension, the same reference numbers have been used, where possible, to identify identical common elements in the drawings. It is understood that elements and characteristics of one embodiment can be conveniently combined incorporated into other embodiments without further clarifications.

DESCRIPTION OF SOME EMBODIMENTS

Figure 3:
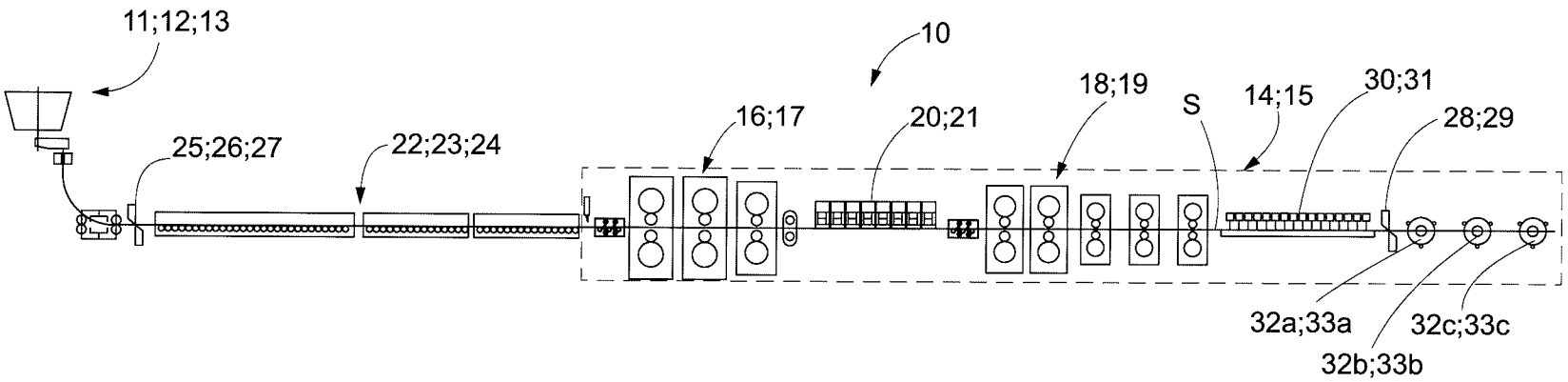
FIGS. 3 and 4 show, respectively in a lateral and plan view, a lay-out of a rolling plant in which the production method according to the invention is applicable.
Figure 4:
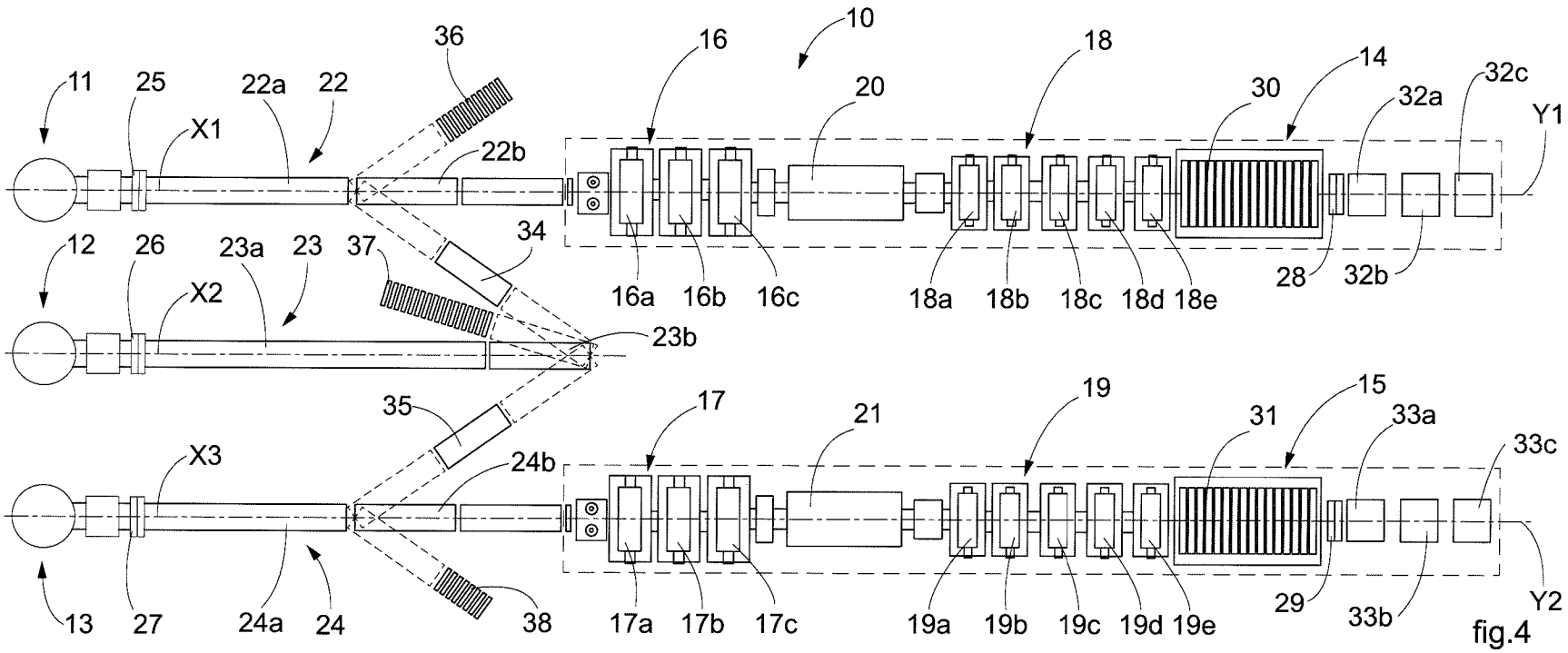

With reference to FIGS. 3 and 4, an example of a co-rolling plant 10 according to the present invention for producing strips S is shown, in which two casting machines or lines 11, 13 are aligned with a respective rolling line 14, 15, while another casting line 12 is disposed centrally between the first two casting lines 11, 13.

We wish to clarify that the example described must not be considered as limiting, in any sense whatsoever, the applicability of the present invention, since the concepts set forth are applied in many other plant configurations, and in any case in all those situations in which the aim is to perform endless or semi-endless or coil-to-coil rolling in a plant 10 which has at least three casting lines and two rolling lines, maximizing overall production in all operating modes on the basis of production and maintenance needs, or unexpected stoppages.

Even the thickness sizes of the strip S produced in the plant 10, which can be comprised between about 0.6 mm and about 25 mm and obtained starting from a slab that has a thickness comprised between about 90 mm and about 160 mm, must not be considered as limiting the applicability of the present invention in any sense whatsoever.

In this specific case, the plant 10 comprises three casting machines or lines 11, 12, 13 disposed in parallel side by side with their respective casting axes X1, X2, X3 parallel to each other.

A first and a second casting line 11, 13, which are the most external ones, that is, disposed laterally, hereafter also referred to as lateral casting lines 11, 13, are followed downstream respectively by a first and a second rolling line 14, 15 which develop along respective rolling axes Y1, Y2 parallel to each other and aligned respectively with the casting axes X1, X3 of the lateral casting lines 11, 13.

A third casting line 12, hereafter also referred to as central casting line 12, is disposed centrally with respect to the first two and is configured to supply the slabs B produced to the rolling lines 14, 15, as will be explained in more detail below.

The two rolling lines 14, 15, during use, can therefore receive and roll the cast products arriving from all three casting lines 11, 12, 13. This configuration guarantees a high flexibility of the plant, which can operate in combined endless, semi-endless or coil-to-coil mode, as will be described below.

In this specific case, the rolling lines 14, 15 comprise a respective roughing train 16, 17, having in this specific case three stands 16*a*-16*c*, 17*a*-17*c*, and a finishing train 18, 19 comprising in this specific case five stands 18*a*-18*e*, 19*a*-19*e*.

Between the roughing train 16, 17 and the finishing train 18, 19 there is a temperature restore system, for example an induction furnace 20, 21, which brings the bar exiting from the roughing train 16, 17 back to the correct rolling temperature.

Downstream of the casting machines 11, 12, 13 there is a respective tunnel furnace 22, 23, 24 having a length sufficient to contain at least a number of slabs comprised between 2 and 5.

The tunnel furnaces 22, 23, 24, in a known way, allow both to act as a buffer in the event of even a momentary interruption of the rolling line(s) 14, 15, and also to operate in semi-endless mode.

In particular, the tunnel furnace 23 of the central casting line 12, hereafter also referred to as central tunnel furnace 23, can act as an accumulation buffer for the entire plant 10 since, as will be better explained below, it allows the passage of the slabs B from and toward the tunnel furnaces 22, 24 of the lateral casting lines 11, 13, hereafter also referred to as lateral tunnel furnaces 22, 24, and therefore toward the rolling lines 14, 15.

In particular, the lateral tunnel furnaces 22, 24 are disposed aligned between the respective lateral casting line 11, 13 and the corresponding rolling line 14, 15 located downstream.

Upstream of the tunnel furnaces 22, 23, 24 there is a respective first pendular shear 25, 26, 27 which cuts to size the cast product into slabs B, when the respective casting line 11, 12, 13 operates in semi-endless or coil-to-coil mode.

Downstream of the finishing trains 18, 19 there is a respective second flying shear 28, 29 which intervenes if rolling in endless or semi-endless mode in order to transversely cut the strip S obtained to the winding size in order to alternatively feed the downcoilers 32*a*-32*c*, 33*a*-33*c*, after the parts cut to size have passed through a respective cooling unit 30, 31. The second flying shears 28, 29 are therefore disposed respectively between the cooling unit 30, 31 and the downcoilers 32*a*-32*c*, 33*a*-33*c*.

The strip S can be divided longitudinally, in such a way as to obtain portions of strip with a width submultiple of the width of the starting cast product. To this end, the strip S can be rolled with double or multiple crowns so that the subsequent half-strips, or pluri-strips, which will be obtained from the strip S each have a correct crown, as if they had been rolled individually.

We wish to clarify that the longitudinal subdivision of the strip S can occur immediately downstream of the finishing unit 18, 19, or directly during the winding on the downcoilers 32*a*-32*c*, 33*a*-33*c* with special dedicated devices, or in a step that follows the removal of the coil, for example in a different plant where the strips S are to be used.

The method for producing a strip S therefore provides a casting step in which at least two casting lines 11, 12, 13 simultaneously produce a respective continuously cast product which can be sectioned into slabs B of suitable length by means of the first pendular shear 25, 26, 27 if they are fed to the two rolling lines 14, 15 in semi-endless or coil-to-coil mode, or remain in the form of a continuous slab if fed to the two rolling lines 14, 15 in endless mode.

The casting step is followed by a movement step in which the slabs B are moved downstream through and by means of the tunnel furnace 22, 23, 24 present downstream of the respective casting line 11, 12, 13.

Each tunnel furnace 22, 23, 24 provides one or more respective fixed modules 22*a*, 23*a*, 24*a* and at least one respective mobile module 22*b*, 23*b*, 24*b* which can cooperate in an alternate manner with at least one other mobile module 22*b*, 23*b*, 24*b* of an adjacent tunnel furnace 22, 23, 24 in order to define a transfer path along which the slabs B are conveyed in a desired manner first toward one or both of the lateral tunnel furnaces 22, 24, and then toward the rolling line 14, 15 located downstream, depending on the specific needs of the process.

In this specific case, the mobile module 23*b* of the central tunnel furnace 23 can cooperate in an alternate manner with at least one mobile module 22*b*, 24*b* of the lateral tunnel furnaces 22, 24. This configuration, which we wish to clarify is not limiting in any way whatsoever, is particularly advantageous because the central tunnel furnace 23 is equidistant from the two rolling lines 14, 15 and therefore allows it to act as a connection between the two more external lines, guaranteeing reduced times for moving the slabs B.

In the solution shown in FIG. 4, the penultimate module 22*b*, 24*b* of the lateral tunnel furnaces 22, 24 is mobile in rotation at least between a first position in which it is aligned with the respective casting axis X1, X3 allowing the transit of the slabs B toward the rolling line 14, 15 located downstream, and a second position in which it is disposed at an angle with respect to the corresponding casting axis X1, X3 and it is aligned, when necessary, with the terminal module 23*b* of the central tunnel furnace 23.

In turn, the terminal module 23*b* is mobile in rotation at least between a position aligned with the respective casting axis X2 in order to receive the slabs B directly produced by the central casting line 12, or from a warehouse for storing the cold slabs, and an angled position aligned with one of the penultimate mobile modules 22*b*, 24*b* of the lateral casting lines 11, 13.

A similar solution can be obtained by translating the mobile modules 22*b*, 23*b*, 24*b*, laterally and parallelly, in a shuttle-like manner, in a direction orthogonal to the casting axes X1, X2, X3 until obtaining the alignment necessary to define a linear path for the transfer of the slab/s B.

In the solution described, the plant 10 also comprises two intermediate connection furnaces 34, 35 for equalization disposed in a fixed position and angled in such a way that the mobile modules 22*b*, 23*b*, 24*b*, when they rotate to cooperate with each other as described above, also align with the respective intermediate furnace 34, 35 which acts as a connection and partly as a buffer.

However, it is also possible to provide configurations in which the mobile modules 22*b*, 23*b*, 24*b* that cooperate with each other can define a passage line directly without the aid of intermediate components.

At the sides of the tunnel furnaces 22, 23, 24, emergency roller conveyors 36, 37, 38 can be provided which can receive one or more slabs B if it is necessary to carry out maintenance or other. The slabs B are conveyed onto the emergency roller conveyors 36, 37, 38 directly by means of the mobile modules 22*b*, 23*b*, 24*b* which can therefore rotate in order to align with the roller conveyors 36, 37, 38.

FIGS. 5-15 show possible operating modes of the plant 10 just described.

Figure 5:
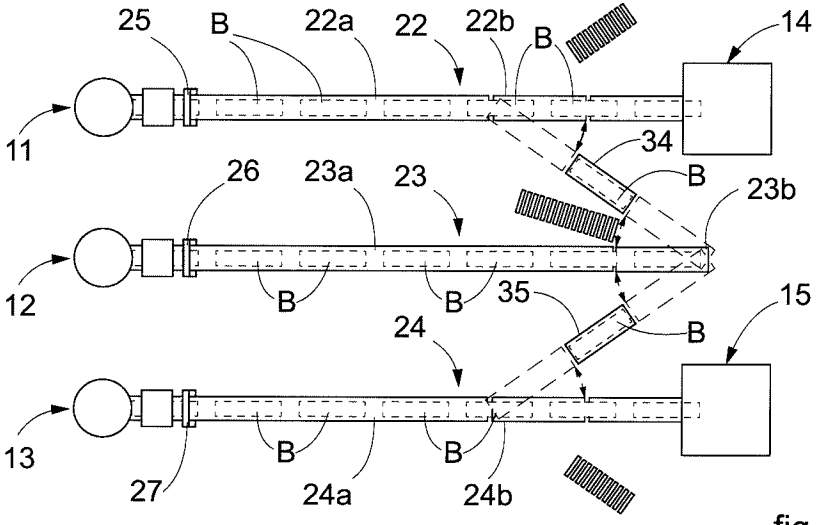

According to a first operating mode, shown in FIG. 5, the casting step occurs simultaneously in the three casting lines 11, 12, 13. The slabs B produced in the central casting line 12 are conveyed, preferably in equal measure, toward the two rolling lines 14, 15 which operate in semi-endless or coil-to-coil mode. In the case of semi-endless rolling downstream of the finishing units 18, 19 the strip S is cut to size transversely with the second flying shear 28, 29 before the winding on the downcoilers 32*a*-32*c*, 33*a*-33*c*. In this first operating mode, the plant 10 can reach a total nominal capacity of about 7.5 Mton/y ear.

Figure 6:
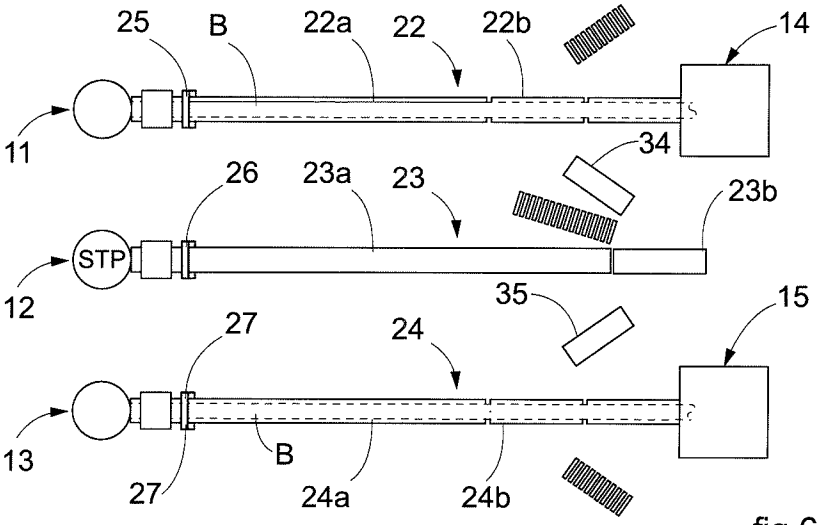
FIGS. 5-15 show possible operating modes of the production method according to the invention.

In accordance with a second operating mode, shown in FIG. 6, the casting step occurs simultaneously in the lateral casting lines 11, 13, which are in direct engagement with the respective rolling lines 14, 15 in endless mode, while the central casting line 12 is stopped. Similarly to the previous case, also in this case downstream of the finishing units 18, 19 the strip S is cut transversely with the second flying shear 28, 29 before the winding on the downcoilers 32*a*-32*c*, 33*a*-33*c*. In this second operating mode, the plant 10 can reach a total nominal capacity of about 5 Mton/year.

Here and hereafter in the description, to make the interpretation of the drawings clear, when one of the casting lines 11, 12, 13 or one of the rolling lines 14, 15 is stopped for any reason, it is identified with the symbol STP.

Figure 7:
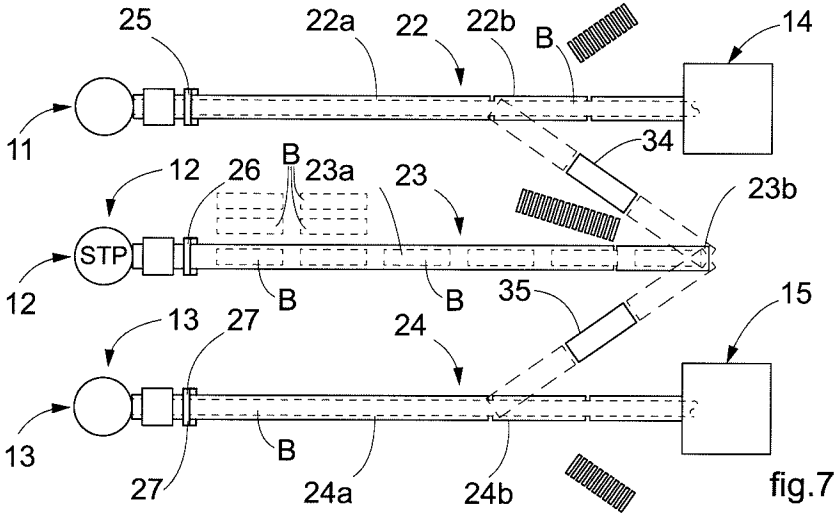

According to a third operating mode, shown in FIG. 7, the casting step occurs simultaneously in the lateral casting lines 11, 12, which are in direct engagement with the respective rolling lines 14, 15 in endless mode, while the central casting line 12 is stopped. Furthermore, the central tunnel furnace 23 is used to heat previously produced cold slabs B. These slabs B may also have been conveniently surface treated with grinding or scarfing techniques in order to produce strips S of high surface quality for so-called "exposed" use in the automotive sector. In this third operating mode, the plant 10 can reach a total nominal capacity of about 5 Mton/year.

Figure 8:
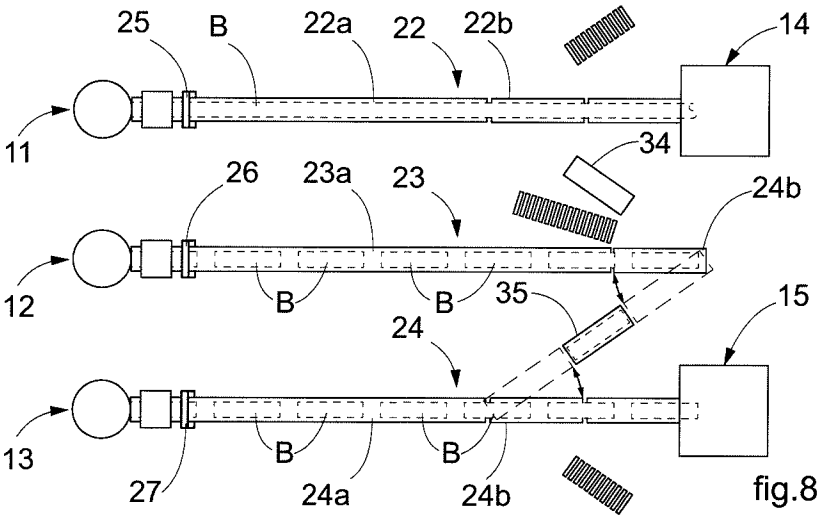
Figure 9:
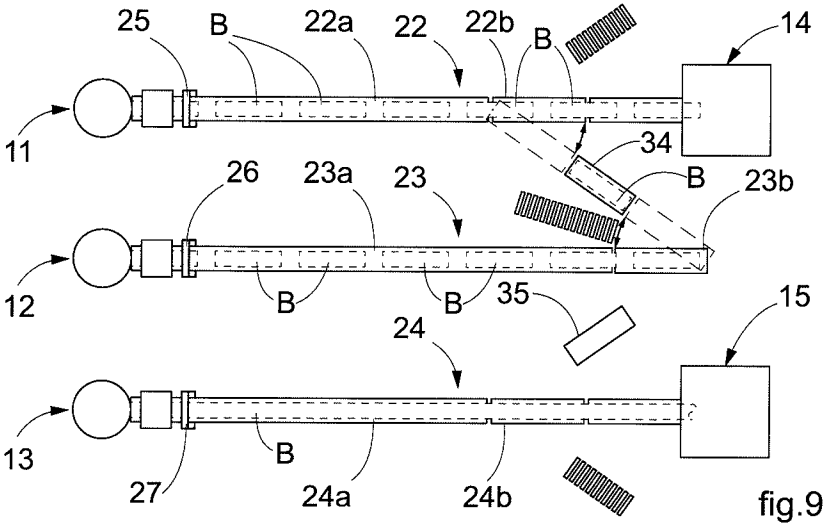

In a fourth and fifth operating mode, respectively shown in FIGS. 8-9, the casting step occurs in endless mode in one of the two lateral casting lines 11, 13, which is in direct engagement with the respective rolling line 14, 15, while the other lateral casting line 11, 13 and the central casting line 12 feed the other rolling line 15, 14 in semi-endless or coil-to-coil mode. The slabs B produced in the central casting line 12 are conveyed toward the rolling line 14, 15 which is operating in semi-endless or coil-to-coil mode. In this fourth and fifth operating mode, the plant 10 can reach a total nominal capacity of about 7 Mton/y ear.

Figure 10:
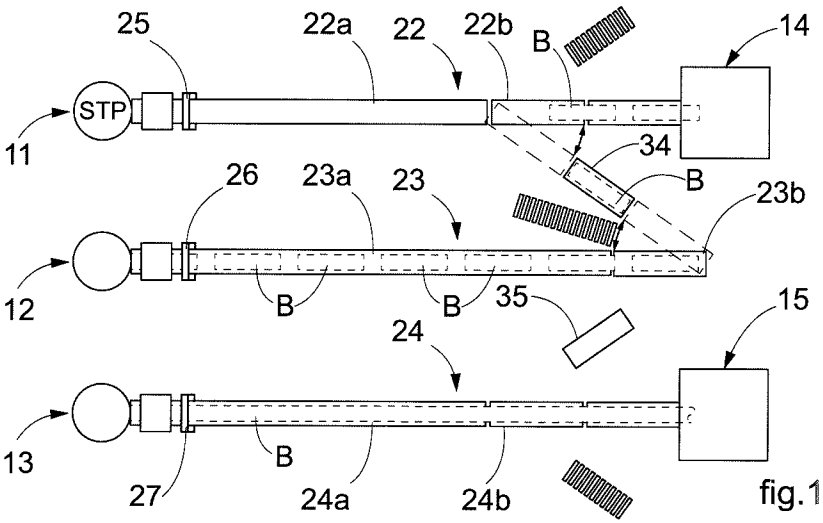
Figure 11:
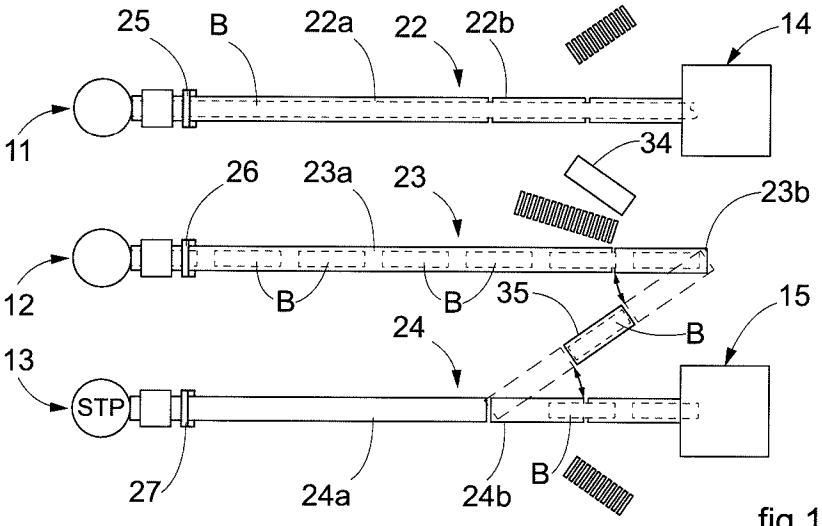

As shown in FIGS. 10-11, which show a sixth and seventh operating mode, if it is necessary to interrupt the casting in one of the lateral casting lines 11, 13, those which are aligned with the respective rolling lines 14, 15, the lateral casting line 11, 13 still in operation feeds the respective rolling line 14, 15 in endless mode, while the central casting line 12 feeds the other rolling line 14, 15 in coil-to-coil mode. The slabs B produced in the central casting line 12 are conveyed toward the rolling line 14, 15 downstream of the casting line 11, 13 not in operation. In this sixth and seventh operating mode, the plant 10 can reach a total nominal capacity of about 5 Mton/y ear.

Figure 12:
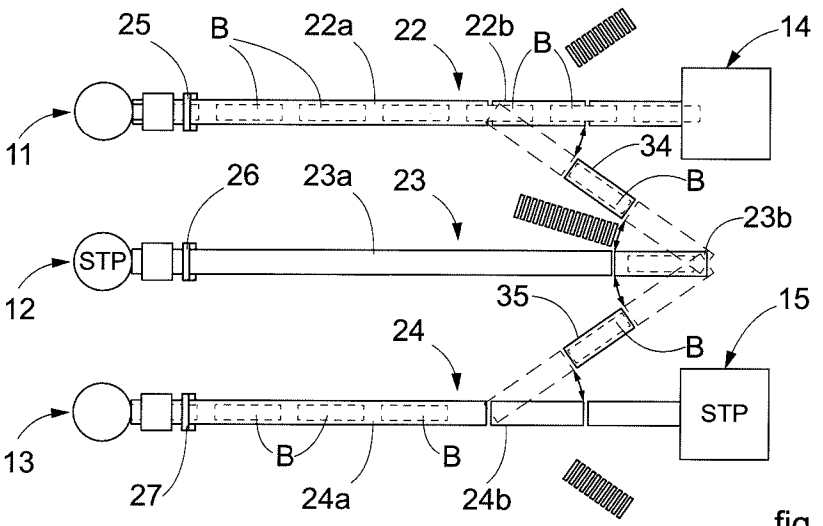
Figure 13:
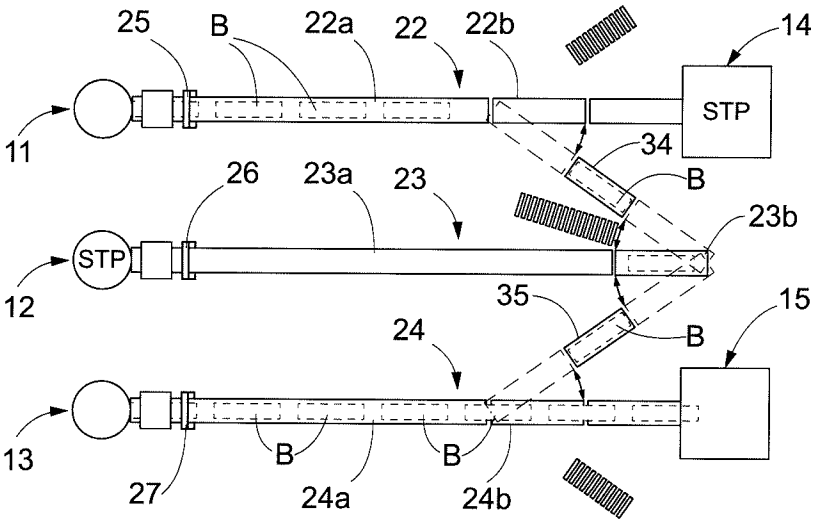

An eighth and ninth operating mode are shown in FIGS. 12-13. If it is necessary to interrupt the casting of the central casting line 12 and one of the rolling lines 14, 15 is stopped, for example for maintenance, the casting step occurs simultaneously in the lateral casting lines 11, 13 and the slabs B produced in the lateral casting line 11, 13 whose respective rolling line 14, 15 is stopped are conveyed toward the rolling line 14, 15 in operation by means of the central tunnel furnace 23, which acts as an interconnection between the lines. This rolling line 14, 15 will operate in semi-endless or coil-to-coil mode. In this eighth and ninth operating mode, the plant 10 can reach a total nominal capacity of about 4.5 Mton/y ear.

Figure 14:
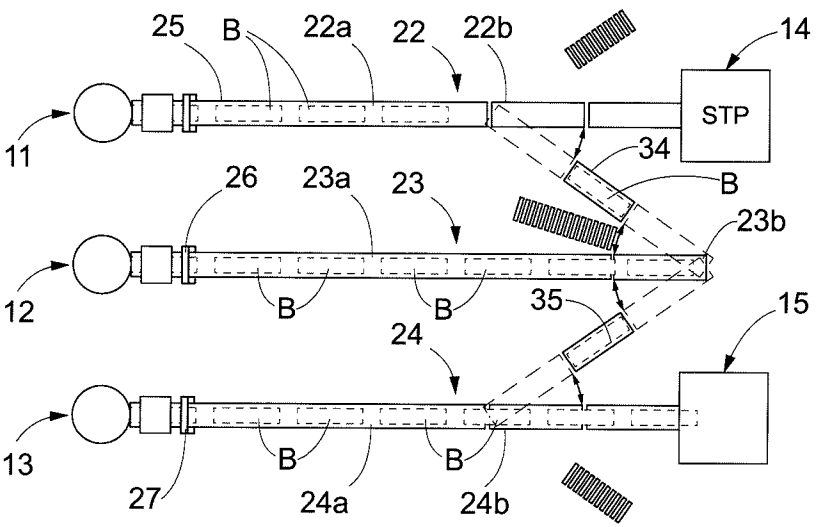
Figure 15:
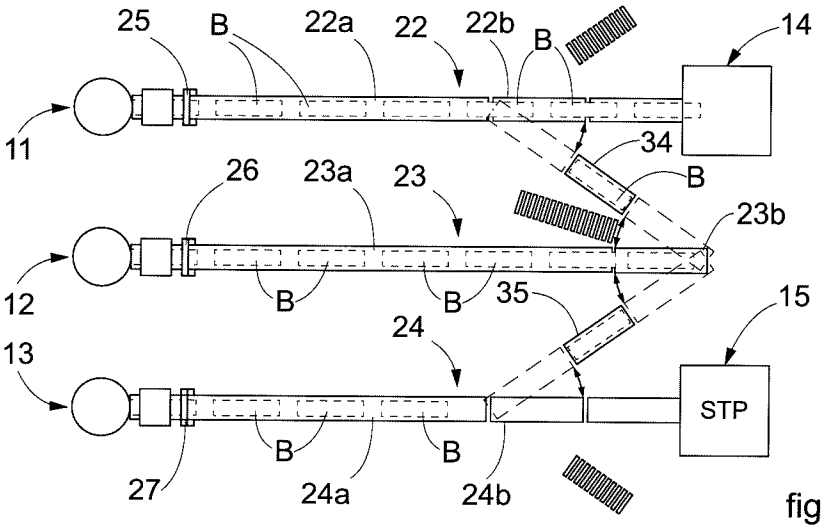

An additional tenth and eleventh operating mode are shown in FIGS. 14-15. If one of the rolling lines 14, 15 is stopped, for example for maintenance, the casting step can in any case occur simultaneously in all three casting lines 11, 12, 13. The slabs B produced in the central casting line 12 and in the lateral casting line 11, 13 with the rolling line 14, 15 stopped are all conveyed toward the rolling line 14, 15 in operation, which will operate in semi-endless or coil-to-coil mode.

It is clear that modifications and/or additions of parts or steps may be made to the method and plant for producing flat rolled products as described heretofore, without departing from the field and scope of the present invention as defined by the claims.

In the following claims, the sole purpose of the references in brackets is to facilitate reading and they must not be considered as restrictive factors with regard to the field of protection claimed in the specific claims.

The invention claimed is:

1. Method for producing flat rolled products, to obtain strips in a plant configured to operate in endless, semi-endless or coil-to-coil mode, having at least three casting lines disposed in parallel, of which two are lateral and one is central, and at least two rolling lines aligned with said lateral casting lines, comprising in sequence:

a casting step in which at least two of said casting lines simultaneously produce a respective continuously cast product, a first cutting step performed downstream of the casting when one or more of said casting lines operate in semi-endless or coil-to-coil mode, in which said cast product is cut into slabs of suitable length by means of a first shear, a movement step in which said slabs or said cast product are moved downstream through and/or by means of a respective tunnel furnace, each provided with one or more respective fixed modules and at least one respective mobile module which is suitable to selectively cooperate, in an alternate manner, when one or more of said casting lines operate in semi-endless or coil-to-coil mode, with at least another one of said at least one mobile module of an adjacent tunnel furnace in order to define a transfer path along which said slabs are conveyed in a desired manner toward one of the two tunnel furnaces associated with the lateral casting lines, and then toward one or both of the rolling lines, depending on the specific needs of the process, a rolling step provided in sequence, for each of said rolling lines, by a respective roughing train and by a respective finishing train, a temperature restoring being provided by a respective induction furnace located between said roughing train and said finishing train, a second cutting step performed downstream of the rolling when one or more of said casting lines operate in semi-endless or endless mode, in which said strip just rolled is cut by means of a second shear once the length that determines the desired weight of the coil to be produced has been reached, and wherein the casting step occurs in endless mode in one of the two lateral casting lines which is in direct engagement with the respective rolling line, while the other lateral casting line and the central casting line operate in semi-endless or coil-to-coil mode with the other rolling line.

2. Method as in claim 1, wherein said at least one mobile module of the tunnel furnace associated with the central casting line cooperates in an alternate manner with at least one mobile module of the tunnel furnaces associated with the lateral casting lines.

3. Method as in claim 1, wherein said casting step occurs simultaneously in said at least three casting lines and the slabs produced in the central casting line are conveyed toward the rolling lines, which operate in semi-endless or coil-to-coil mode.

4. Method as in claim 1, wherein said casting step occurs simultaneously in the lateral casting lines which are in direct engagement with the respective rolling lines in endless mode while the central casting line is stopped.

5. Method as in claim 4, wherein during said casting steps, the tunnel furnace associated with the central casting line is used to heat previously produced and stored slabs.

6. Method as in claim 1, wherein if it is necessary to interrupt the casting in one of the lateral casting lines, which are aligned with the respective rolling line, the casting step proceeds in endless mode in the lateral casting line still in operation, while the slabs produced in the central casting line are conveyed toward the rolling line located downstream of the stopped lateral casting line which rolls in coil-to-coil mode.

7. Method as in claim 1, wherein if it is necessary to interrupt the casting of the central casting line and one of the rolling lines is stopped, the casting step occurs simultaneously in the other lateral casting lines and the slabs produced in the lateral casting line having the downstream rolling line stopped are conveyed toward the operating rolling line that operates in semi-endless or coil-to-coil mode.

8. Method as in claim 1, wherein if one of the rolling lines is stopped, the casting step occurs simultaneously in all the casting lines and the slabs produced in the central casting line and in the lateral casting line having the downstream rolling line stopped are conveyed toward the operating rolling line that operates in semi-endless or coil-to-coil mode.

* * * * *